United States Patent [19]

Ninomiya et al.

[11] 4,316,362

[45] Feb. 23, 1982

[54] METHOD AND APPARATUS FOR OPERATING A CROSS-COMPOUND TURBINE GENERATOR PLANT

[75] Inventors: Satoshi Ninomiya; Yasuhiro Yamachi; Katsukuni Hisano, all of Hitachi; Ryosuke Arie, Katsuta; Katsuto Kashiwahara; Hidesumi Kuwashima, both of Hitachi, all of Japan

[73] Assignee: Hitachi, Ltd., Tokyo, Japan

[21] Appl. No.: 97,498

[22] Filed: Nov. 26, 1979

[30] Foreign Application Priority Data

Nov. 29, 1978 [JP] Japan ..... 53-146544

[51] Int. Cl.[3] ..... F01K 13/02

[52] U.S. Cl. ..... 60/646; 60/656; 60/715

[58] Field of Search ..... 60/646, 657, 656, 715

[56] References Cited

U.S. PATENT DOCUMENTS

| | | | |
|---|---|---|---|
| 2,902,831 | 9/1959 | Ipsen | 60/656 |
| 3,163,991 | 1/1965 | Capitaine | 60/646 |
| 4,007,597 | 2/1977 | Jaegtnes et al. | 60/715 X |

*Primary Examiner*—Allen M. Ostrager
*Attorney, Agent, or Firm*—Craig and Antonelli

[57] ABSTRACT

A cross compound turbine apparatus and method of operating the same wherein the apparatus includes a first turbine generator having a high pressure turbine and a first low pressure turbine connected to a first generator driving shaft, with the second turbine generator having an intermediate pressure turbine connected to a second generator driving shaft. Driving steam is supplied to the high pressure turbine and a primary steam line communicates exhaust steam from the high pressure turbine to drive the intermediate pressure turbine during a steady state operation of the first and second turbine generator sections. A bypass steam line communicates steam from the system supplying driving steam to the high pressure turbine to the intermediate pressure turbine in a bypassing relationship to the high pressure turbine. A control arrangement controls the flow of steam in the primary and bypass steam lines during a starting operating of the turbine generator sections, with the control arrangement being adapted to maintain the relative speeds of the first and second generator driving shafts in a predetermined synchronsis ratio. A controllable vent arrangement is provided for venting a portion of the steam flow in the primary steam line during starting operations. By virtue of these features, a speed synchronization of multiturbine sections can be obtained in an efficient and inexpensive manner without causing excessive heat rise in the turbine blades.

16 Claims, 3 Drawing Figures

METHOD AND APPARATUS FOR OPERATING A CROSS-COMPOUND TURBINE GENERATOR PLANT

BACKGROUND AND SUMMARY OF THE INVENTION

This invention relates to a multiple turbine-generator plant and particularly to a cross compound turbine-generator plant, which has first and second turbine-generator sections.

Preferred embodiments of the invention relate to cross-compound turbine-generator plants which comprise a first generator rotated by a high pressure turbine and a low pressure turbine, and a second generator rotated by an intermediate pressure turbine and a low pressure turbine. The inlet of the high pressure turbine is connected to a superheater while steam exhausted from the high pressure turbine is reheated and returned for use by the intermediate turbine of the second turbine-generator section by the respective low pressure turbines of the first and second turbine-generator sections. In practical embodiments of this type of cross-compound turbine-generator, it is required to rotate the first and second generators in a predetermined synchronized rotating speed ratio, such as 3,000 R.P.M. and 1,500 R.P.M. (2/1 ratio of rotational speeds). This speed synchronization is necessary in order that the two generators may be locked in step electrically prior to connecting to an electrical network being supplied.

In a starting operation of this type of cross-compound turbine, U.S. Pat. No. 2,902,831, suggests employing a bypass line which is connected from a steam generator to the second turbine section across the first turbine section, so that the speed synchronization of the first and second sections may be accomplished by controlling a starting valve provided along the bypass line. However, in the case where the bypass line is connected across the high pressure turbine of the first section, the pressure at the exit of the high pressure turbine cannot but become higher, because the exit of the high pressure turbine is connected to the inlet of the intermediate pressure turbine of the second section, where high pressure steam is introduced through the bypass line. If the pressure at the exit of the high pressure turbine becomes higher, the high pressure turbine is required to rotate in a highly pressurized atmosphere which causes excessive temperature rise in the turbine blades due to friction heat. Also, if the exit pressure of the high pressure turbine becomes a higher, the amount of work done in the high pressure turbine becomes smaller and the speed synchronization of the first and second sections cannot be accomplished.

An object of the present invention is to provide a method and apparatus of operating a cross-compound turbine-generator plant in which a speed synchronization of multi-turbine sections can be attained in an efficient and inexpensive manner without causing excessive heat rise in the turbine blades.

A further object of the invention is to provide a method and an apparatus for operating a cross compound turbine-generator plant, with a bypass line which conducts steam, from steam sources to a second turbine section across a first turbine section.

According to preferred embodiments of the present invention, a cross-compound steam turbine generator plant is provided which includes a first electric generator and a second electric generator for generating electrical current with a predetermined frequency. The first generator is driven by a high pressure turbine and a low pressure turbine, and the second generator is driven by an intermediate pressure turbine and a low pressure turbine. During starting operating conditions, high pressure steam is separately supplied to the high pressure turbine by a main supply line and to the intermediate pressure turbine by a bypass line, with the exhaust steam from the high pressure turbine being advantageously vented so that excessive friction heat may be removed from this exhaust steam. This arrangement advantageously prevents damage to the turbine units during starting conditions while accommodating synchronization of the two generators. Further, the reduction in pressure at the exit side of the high pressure turbine during starting conditions improves the operating efficiency.

According to a first preferred embodiment of the invention a portion of the exhaust from the high pressure turbine is vented by means of a controlled dumping valve located in a vent line extending from the high pressure turbine exhaust to a condenser of the first turbine-generator section. In this arrangement, the dumping valve is preferably controlled by a controller which also controls the supply of driving steam into the high pressure turbine and the supply of driving steam to the bypass line during starting conditions, whereby the controller can advantageously also synchronize the speeds of the two turbine-generator sections.

According to another preferred embodiment of the invention a portion of the exhaust from the high pressure turbine is vented by means of a controlled dumping valve located in a vent line extending from the high pressure turbine exhaust to the low pressure turbine of the first turbine-generator section, thereby aiding in driving said low pressure turbine during starting conditions. Alternative preferred embodiments vent a portion of the high pressure turbine exhaust to assist in driving the low pressure turbine of the second turbine-generator section.

The dumping valves of preferred embodiments of the present invention are also preferably controlled to vent a portion of the exhaust from the high pressure turbine during stopping operations.

These and other objects, features and advantages of the present invention will become more apparent from the following description taken in connection with the accompanying drawings which show, for purposes of illustration only, several embodiments in accordance with the present invention, and wherein:

DETAILED DESCRIPTION OF THE DRAWINGS

Figure 1:
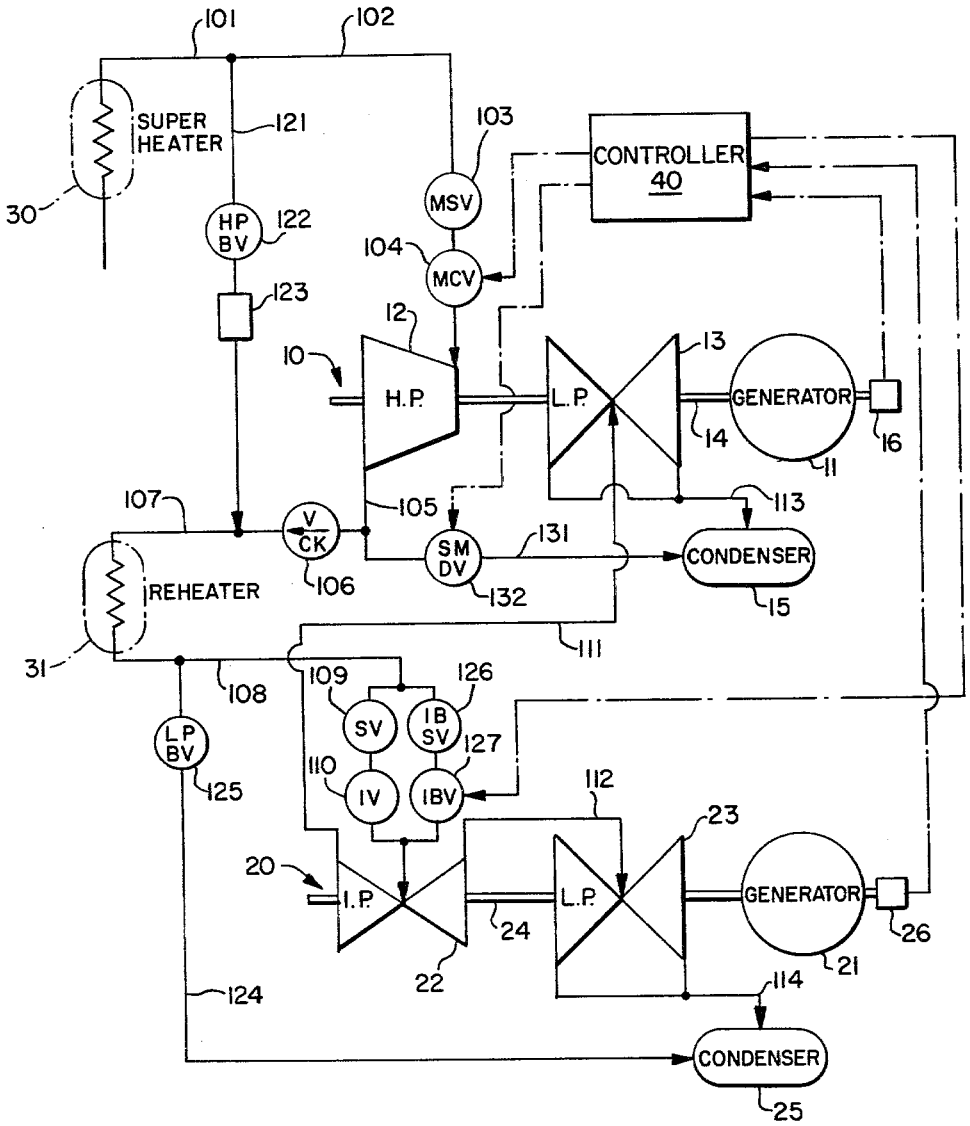
FIG. 1 schematically shows a cross-compound turbine generator plant constructed in accordance with a preferred embodiment of the present invention.

Referring to FIG. 1, a cross-compound turbine-generator plant is provided which includes a first turbine-generator section 10 and a second turbine-generator section 20. The first turbine-generator section 10 has an electric generator 11 which is driven by a high pressure turbine 12 and a low pressure turbine 13 coaxially coupled to a shaft 14. The second turbine-generator section 20 has an electric generator 21 which is driven by an intermediate pressure turbine 22 and a low pressure turbine 23 coaxially coupled to a shaft 24. High pressure steam which is generated in a superheater 30 flows through a line 101, 102 and is supplied to the first turbine section 10. The steam passes through a main stop valve 103 and a main control valve 104 to an inlet of the high pressure turbine 12. After its passage through the high pressure turbine 12, steam is exhausted to a reheater 31 through lines 105 and 107. Between the lines 105 and 107, there is provided a check valve 106 to prevent reverse flow into the exit portion of the high pressure turbine 12.

From the reheater 31, steam passes through line 108, a stop valve 109 and an intercept valve 110 to an inlet of the intermediate pressure turbine 22. The exhausted steam from the intermediate pressure turbine is then divided into two and conducted to the inlets of the respective low pressure turbines 13 and 23 through lines 111 and 112. The exhausted steam from the low pressure turbines is introduced to condensers 15 and 25 through lines 113 and 114.

From the superheater 30, a high pressure bypass line 121 is connected between the superheater 30 and the inlet line 107 for the reheater 31. A high pressure bypass valve 122 is connected to control the flow of steam through the line 121, and a cooler 123 may be used to desuperheat the steam passing through the line 121. Also, there is provided a low pressure bypass line 124 connecting between the outlet line 108 of the reheater 31 and the condenser 25. A low pressure bypass valve 125 is connected to control the pressure in the reheater 31. These bypass lines 121 and 124 work not only as safety valves for steam sources but also work to help to increase the temperature of the reheater 31 at the starting operation, and to prevent overheating of the reheater 31 at the stopping operation. Also, the bypass line 121 is employed at the starting operation and under a low load operating condition, because in such operating conditions, sufficient quantity of power is required to rotate the respective turbine sections to a rated rotating speed. An intercept bypass stop valve 126 and an intercept bypass valve 127 are provided between the reheater 31 and the inlet of the intermediate pressure turbine 22. The amount of steam flow through to the bypass line 121 to the intermediate pressure turbine is controlled by the intercept bypass valve 127.

At the exit of the high pressure turbine 12 from the line 105, a speed matching dump line 131 is connected to conduct exhausted steam from the high pressure turbine 12 to the condenser 15. By means of the speed matching dump line 131, the pressure at the exit of the high pressure turbine 12 can be decreased even if high pressurized steam is introduced through the bypass line 121 to the check valve 106 provided at the exit of the high pressure turbine 12. The exhaust steam is ventilated or vented to the condenser 15 and therefore the pressure at the exit of the high pressure turbine can be controlled to a desired value by controlling a speed matching dump valve 132 (SMDV) connected to control the flow of steam through the speed matching dump line 131. As explained above, speed synchronization of the first and second generators 11, 21 prior to connecting to the electrical network is required to avoid electrical phase difference between the two generators. This is particularly important when the turbine generator plant is at the starting operation or under low load condition because in these operating conditions the second turbine section 20 is rotated by steam supplied through the bypass line 121. In order to accomplish the speed synchronization, speed detectors 16 and 26 are provided on respective generators 11 and 21, which generate signals corresponding to the rotating speeds of the first and second turbine sections 10 and 20. These speed signals are converted to a control signal by a controller 40 for the control valve 104, speed matching dump valve 132 and intercept bypass valve 127. The speed matching dump valve 132 may be controlled in accordance with a detected value of opening of the main control valve 104, such that the SMDV 132 is proportionally opened to full opening angle until the opening angle of the main control valve 104 reaches, for example, 10% of full opening angle, and thereafter the SMDV is closed.

Figure 2:
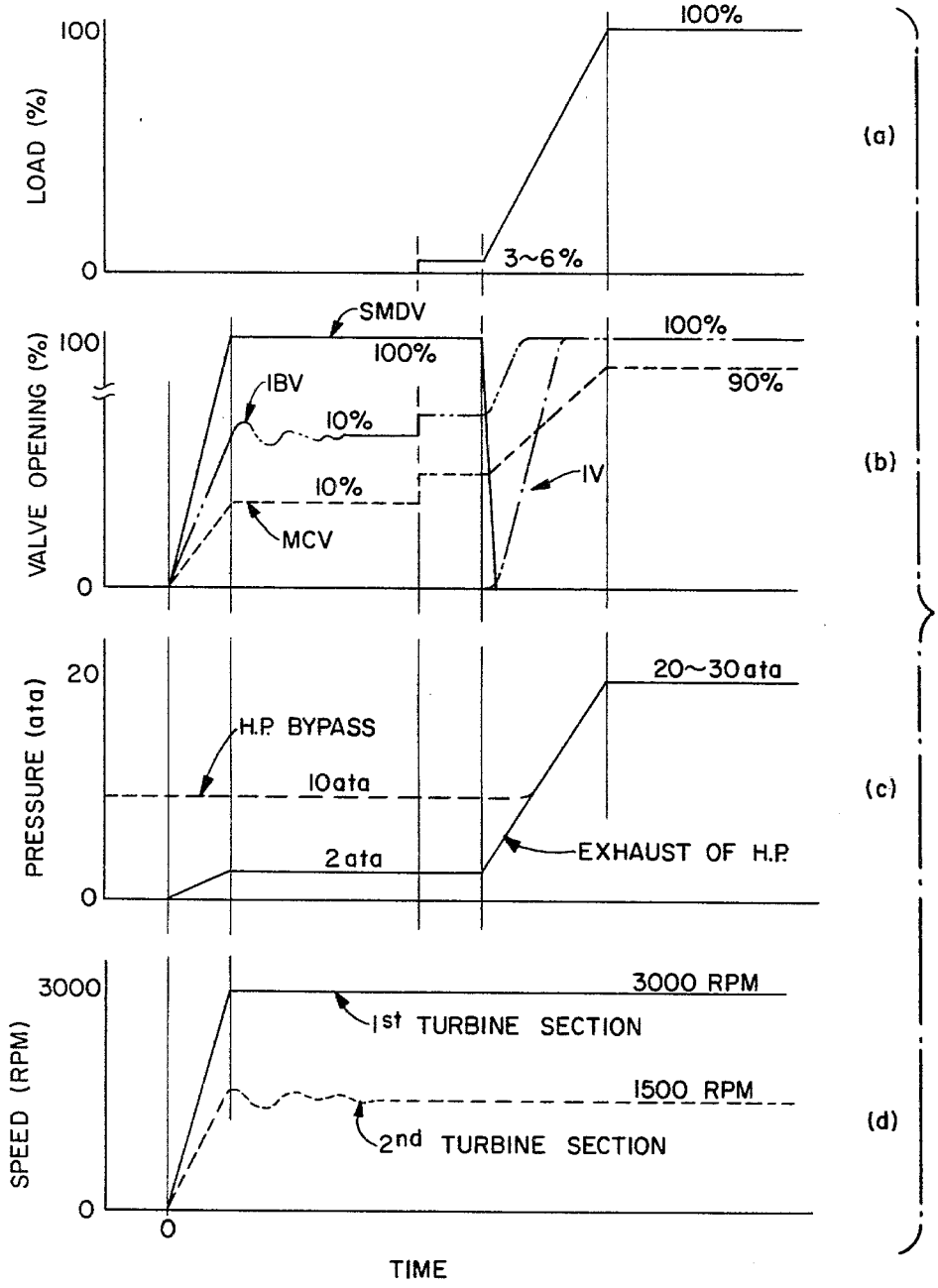
FIG. 2 graphically shows the sequence of events occurring when the apparatus of the present invention is in a start-up operation, in which FIG. 2(*a*) shows load changes, FIG. 2(*b*) shows valve openings, FIG. 2(*c*) shows pressure changes and FIG. 2(*d*) shows speed changes.

Hereafter the operation according to the invention will be explained by reference to the accompanying FIGS. 1 and 2.

(1) Before Starting Cycle

Before the turbine-generator plant starts rotating, all the valves are closed. The high pressure bypass valve 122 and low pressure bypass valve 125 are then slightly opened so that steam from the superheater 30 may be introduced to the reheater 31 through the bypass line 121 and the line 107. No steam flow is permitted through the check valve 106 because the pressure at the downstream side of the check valve 106 is higher than the upstream side of the check valve. The steam flow preheats the reheater 31 and flows into the condenser 25 through the bypass line 124. The pressure in the high pressure bypass line 107 is kept, for example, at 10 ata (atmospheres absolute).

(2) Starting Cycle

At the starting operation, the main stop valve 103 and main control valve 104 are opened, and steam is introduced to the high pressure turbine 12 through the lines 101 and 102. At the same time, SMDV 132 is gradually opened to full opening angle until the main control valve (MCV) 104 is opened, for example, 10% of its full opening angle, so that the exhaust steam from the high pressure turbine 12 may be discharged into the condenser 15. The intercept bypass valve (IBV) 127 and the intercept bypass stop valve (IBSV) 126 are also opened, in order to allow the reheated steam flowing into the intermediate pressure turbine 22 through the bypass line 121, lines 107 and 108. Speed synchronization of the first and second turbine-generator sections 10, 20 are made by controlling the amount of steam fed into the respective high pressure turbine 12 and intermediate pressure turbine 22 through the MCV 104 and IBV 127 in accordance with the speed signals obtained by speed detectors 16 and 26. Accordingly, rotating speeds of the first and second turbine sections are increased up to a predetermined speed ratio such as 3,000 R.P.M. and 1,500 R.P.M.

(3) Loading Cycle

After it has reached its synchronized operating speeds, a load is applied to the turbine generator plant. With the increase of the load, IBV 127 and MCV 104 are gradually opened keeping the synchronous speed by a suitable speed governing system known in the field. In this period, the SMDV is closed and the intercept valve (IV) 110 and the stop valve (SV) 109 are opened. The IV has larger diameter than the IBV, so that the load control is made by the IBV.

(4) Interrupting Operation

When the turbine-generator plant is required to be interrupted because of the load drop, an inverse operation as explained above for the starting operation is applicable. By controlling the SMDV, excessive temperature rise which may otherwise happen at load cut-off is eliminated, because the SMDV is capable to decrease the pressure at the exit of the high pressure turbine.

Figure 3:
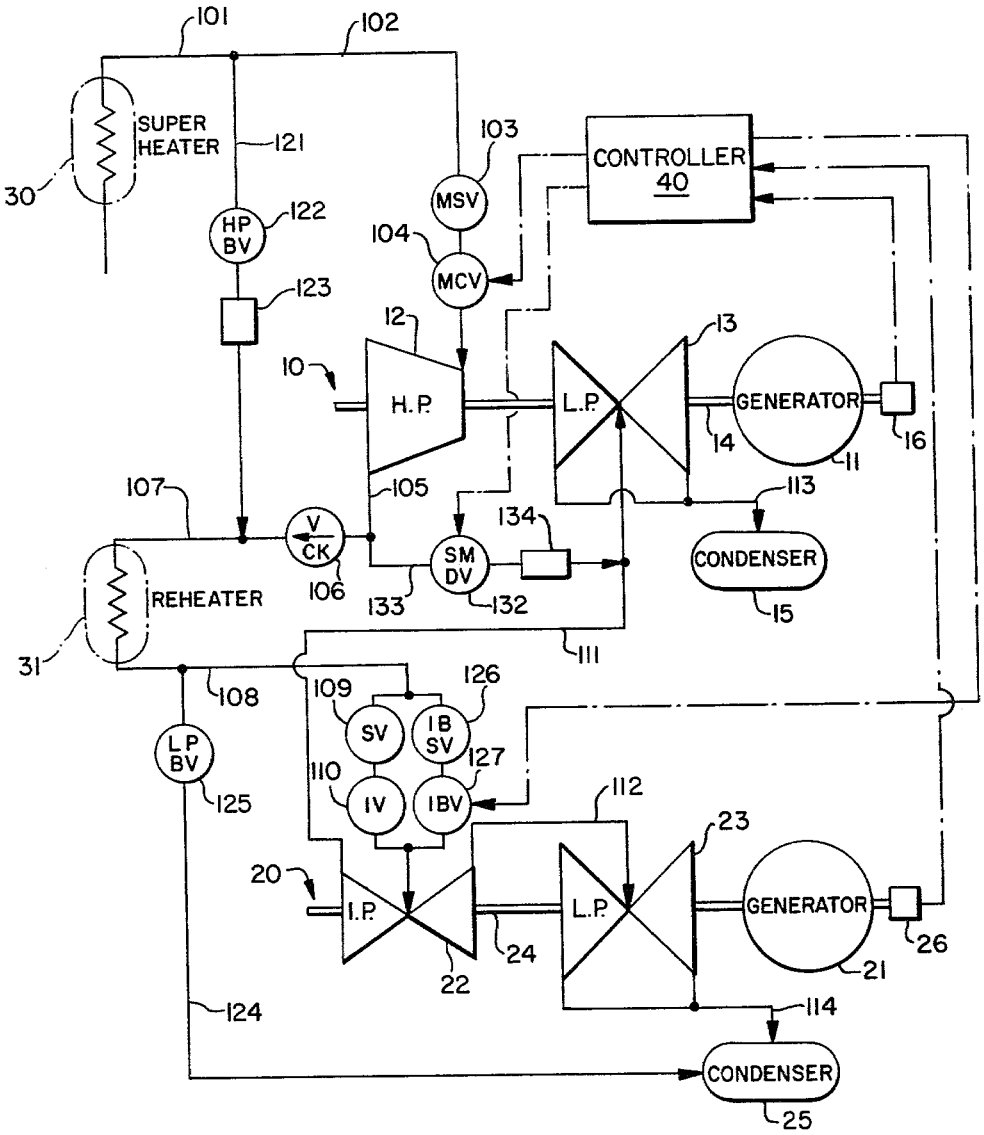
FIG. 3 schematically shows another preferred embodiment of the present invention.

FIG. 3 shows another embodiment of the present invention, in which the speed matching dump line 131 of the embodiment of FIG. 1 is replaced by dump line 133 connected to the low pressure turbine 13. That is, the exhaust steam from the high pressure turbine 12 is introduced into the inlet portion of the low pressure turbine 13 through a speed matching dump line 133. This speed matching dump line 133 is also equipped with a speed matching dump valve (SMDV) 132 and the pressure at the exit of the high pressure turbine 12 can therefore be controlled to a desired amount. Also, it is preferred to provide a cooler 134 to eliminate the flowing of excessively hot steam into the low pressure turbine 13. In this embodiment, exhaust steam is discharged into the low pressure turbine 13. However, other embodiments are contemplated where the exhaust steam from the high pressure turbine is discharged via a speed matching dump valve into the low pressure turbine 23 of the second turbine section 20. These embodiments are effective to increase the heat efficiency of the turbine generator plant.

It should be noted that by controlling the pressure at the exit of the high pressure turbine 12, temperature rise in the turbine blades caused by friction heat can be eliminated and speed synchronization of the first turbine section with the second turbine section which is rotated by steam through the bypass line can be attained in an efficient, simple, economical, reliable manner.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What is claimed is:

1. Cross-compound turbine apparatus comprising:

a first turbine-generator section having a high pressure turbine and a first low pressure turbine drivingly connected to a first generator driving shaft, a second turbine-generator section having an intermediate pressure turbine drivingly connected to a second generator driving shaft, steam supplying means for supplying driving steam to said high pressure turbine, primary steam line means communicating exhaust steam from said high pressure turbine to drive said intermediate pressure turbine during steady state operation of said first and second turbine-generator sections, bypass steam line means for communicating steam from said steam supplying means to said intermediate pressure turbine in bypassing relationship to said high pressure turbine, control means for controlling the flow of steam in said primary and bypass steam line means during starting operation of said turbine-generator sections, said control means including means to maintain the relative speeds of the first and second generator driving shafts in a predetermined synchronous ratio, and controllable vent means for venting a portion of the steam flow in the primary steam line means during starting operations.

2. Apparatus as claimed in claim 1, wherein the controllable vent means includes a dumping valve disposed in a dumping line extending away from the primary steam line, and wherein said control means includes means for controlling the opening of the dumping valve to maintain the predetermined synchronous ratio of shaft speeds during starting operations.

3. Apparatus as claimed in claim 2, wherein the dumping line interconnects the primary steam line with a condenser of the first turbine-generator section.

4. Apparatus as claimed in claim 2, wherein the dumping line interconnects the primary steam line with the inlet to said first low pressure turbine, whereby the vented portion of the exhaust steam from the high pressure turbine assists in driving the low pressure turbine during conditions when said dumping valve is open.

5. Apparatus as claimed in claims 1 or 2, wherein further steam line means are provided for communicating exhaust steam from said intermediate pressure turbine to drive said low pressure turbine.

6. Apparatus as claimed in claims 3 or 4, wherein said control means includes means for closing said dumping valve as well as said bypass steam line means after said turbine-generator sections have reached steady state operational speeds and a load has been connected to the generator driving shafts.

7. Apparatus as claimed in claim 1, wherein alternating electrical current generators are drivingly connected to each of said generator driving shafts.

8. Apparatus as claimed in claims 1 or 2, wherein said second turbine-generator section includes a second low pressure turbine.

9. A method of operating a cross-compound turbine of the type including first and second turbine-generator sections, said first turbine-generator section having a high pressure turbine and a first low pressure turbine drivingly connected to a first generator driving shaft, said second turbine-generator section having an intermediate pressure turbine drivingly connected to a second generator driving shaft, comprising:

supplying steam via steam supplying means to drive said high pressure turbine, communicating exhaust steam via primary steam line means from said high pressure turbine to drive said intermediate pressure turbine during steady state operations of said first and second turbine-generator sections, communicating bypass steam via bypass steam lines from said steam supplying means to said intermediate pressure turbine in bypassing relation to the high pressure turbine, controlling the flow of steam via control means in said primary and bypass steam line means during starting operation of said turbine-generator sections, said controlling including maintaining the relative speeds of the first and second generator driving shafts in a predetermined synchronous ratio, and controllably venting a portion of the steam flow in the primary steam line means during starting operations via controllable vent means.

10. A method as claimed in claim 9, wherein the controllable vent means includes a dumping valve disposed in a dumping line extending away from the primary steam line, and wherein said control means includes means for controlling the opening of the dumping valve to maintain the predetermined synchronous ratio of shaft speeds during starting operations.

11. A method as claimed in claim 9, wherein the dumping line interconnects the primary steam line with a condenser of the first turbine-generator section.

12. A method as claimed in claim 10, wherein the dumping line interconnects the primary steam line with the inlet to said first low pressure turbine, whereby the vented portion of the exhaust steam from the high pressure turbine assists in driving the low pressure turbine during conditions when said dumping valve is open.

13. A method as claimed in claims 9 or 10, wherein further steam line means are provided for communicating exhaust steam from said intermediate pressure turbine to drive said low pressure turbine.

14. A method as claimed in claims 11 or 12, wherein said control means includes means for closing said dumping valve as well as said bypass steam line means after said turbine-generator sections have reached steady state operational speeds and a load has been connected to the generator driving shafts.

15. A method as claimed in claim 9, wherein alternating electrical current generators are drivingly connected to each of said generator driving shafts.

16. A method as claimed in claims 9 or 10, wherein said second turbine-generator section includes a second low pressure turbine.

* * * * *